US006776200B2

(12) United States Patent
Dronsejko et al.

(10) Patent No.: US 6,776,200 B2
(45) Date of Patent: Aug. 17, 2004

(54) TRIGGER APPARATUS AND MATERIAL HANDLING APPARATUS INCLUDING THE SAME

(75) Inventors: Krzysztof Dronsejko, Mississauga (CA); Tomasz Garus, Richmond Hill (CA); Steven K. Hamilton, Mississauga (CA)

(73) Assignee: Hamilton Avtec Inc., Mississauga (CA)

( * ) Notice: Subject to any disclaimer, the term of this patent is extended or adjusted under 35 U.S.C. 154(b) by 0 days.

(21) Appl. No.: 10/304,676

(22) Filed: Nov. 27, 2002

(65) Prior Publication Data

US 2003/0098319 A1 May 29, 2003

Related U.S. Application Data

(60) Provisional application No. 60/333,140, filed on Nov. 27, 2001.

(51) Int. Cl.[7] ..... G05D 7/00

(52) U.S. Cl. ..... 141/198; 141/95; 137/425

(58) Field of Search ..... 141/95, 198; 137/386, 137/393–399, 424, 425; 222/56, 64–67

(56) References Cited

U.S. PATENT DOCUMENTS 4,161,677 A * 7/1979 Dill ..... 318/482

* cited by examiner

*Primary Examiner*—J. Casimer Jacyna
(74) *Attorney, Agent, or Firm*—Patrick J. Hofbauer

(57) ABSTRACT

A trigger, for use with a port through which a flow of particulate solid material selectively passes, is disclosed and comprises a sensor and a trigger body having a first position and a second position. The trigger body is biased for movement to said first position; defines a threshold level of said particulate; is adapted to be positioned, in use, beneath said port so as be impinged upon by said flow when at its first position and moved by said flow to its second position; and is adapted, upon accumulation of said particulate beneath said port beyond the threshold level, to be restrained as against movement to said first position by said particulate until such time as the particulate recedes to said threshold level. The sensor produces a signal responsive to movement of the trigger body to its first position. Particulate handling apparatus including the trigger is also disclosed.

20 Claims, 11 Drawing Sheets

TRIGGER APPARATUS AND MATERIAL HANDLING APPARATUS INCLUDING THE SAME

This application claims the benefit of U.S. Provisional Patent Application No. 60/333,140 entitled, DISCHARGE TRIGGER, filed Nov. 27, 2001.

FIELD OF THE INVENTION

The present invention relates to the field of material handling, and more particularly, to triggering apparatuses for use with material handling apparatuses for particulate solid material, and to material handling apparatuses for use with particulate solid material.

BACKGROUND OF THE INVENTION

It is not uncommon in a modern factory for a large number of molding or extrusion devices to be present. Typically, such devices utilize plastic resin in particulate solid (powder or pellet) form as a feedstock. To simplify inventory, as well as material handling, particulate solid plastic resin is shipped in bulk to a central storage area in the factory. From the central storage area, a plurality of conduits extend, each conduit terminating at a respective loader dedicated to one of said molding or extrusion devices. Each loader includes a hopper capable of receiving a volume of said resin and in which a vacuum can be formed, to draw said resin from the central storage area, through the conduit and into the hopper. When the hopper has been filled, the vacuum ceases to be drawn, and a discharge port in the base of the hopper opens to discharge the collected resin material into a receptacle disposed beneath the hopper. As the level of the material in the receptacle drops, the discharge port can be closed, so as to permit further resin material to be drawn into the hopper, to repeat the process.

Closure of the discharge port can, of course, be triggered manually, but it is advantageous to automate the process.

A variety of devices are known in the prior art to automatically trigger such closure of the discharge port. Optical-based devices are currently favoured, for reasons of purchase economy and reliability. However, it is possible for the "lens" portion of such devices to become coated with resin dust, or otherwise soiled, whereupon operation becomes unpredictable. As such, maintenance requirements for triggering apparatus of this type can be substantial.

SUMMARY OF THE INVENTION

It is an object of the present invention to provide a trigger apparatus for use with a material port through which a flow of particulate solid material selectively passes, said trigger apparatus being relatively economical and reliable and having lesser maintenance requirements than devices of similar economy and reliability in the prior art.

This object, and others, is met by one aspect of the present invention, a trigger apparatus for use with a material port through which a flow of particulate solid material selectively passes.

The trigger apparatus comprises a trigger body, a bias means and a sensor means.

The trigger body has a first position and a second position and defines a threshold level of said particulate solid material. The trigger body is adapted to be positioned, in use, beneath said material port so as be impinged upon by said flow when at its first position and moved therefrom by said flow to its second position. The trigger body is further adapted, upon accumulation of said particulate solid material from said flow beneath said material port beyond the threshold level, to be restrained as against movement to said first position by said particulate solid material until such time as the particulate solid material recedes to said threshold level.

The bias means is for biasing the trigger body for movement to its first position.

The sensor means is for producing a signal responsive to movement of the trigger body to its first position.

As other aspects of the invention, the trigger body preferably comprises a vane portion which, in use, is impinged upon by said flow, which impingement provides for said movement of the trigger body from its first position to its second position.

As another aspect of the invention, the trigger apparatus preferably further comprises a float portion.

As a further aspect of the invention, in non-flow conditions when said particulate solid material has accumulated from said flow beneath said material port beyond the threshold level, said particulate solid material preferably blocks movement of the float portion, in the course of said movement of the trigger body from its second position to its first position through the agency of the bias means, thereby to provide for said trigger body to be restrained as against movement to said first position by said particulate solid material until such time as the particulate solid material recedes to said threshold level.

A material handling apparatus including the trigger apparatus and for use with particulate solid material is another aspect of the invention.

In addition to the trigger apparatus, the material handling apparatus comprises a loader.

The loader includes a hopper, a discharge cone, an actuator means and a receptacle.

The hopper is for receiving said particulate solid material and has a discharge port at the base thereof.

The discharge cone has an open position, apart from the discharge port, whereat particulate solid material within said hopper can flow through said discharge port, and a closed position, occluding said discharge port, whereat said flow is arrested.

The actuator means is for selectively moving the discharge cone between the open position and the closed position thereof.

The receptacle is positioned beneath said hopper to receive particulate solid material discharged through said discharge port.

The trigger apparatus is used with the loader with the discharge port of said hopper defining the material port, the trigger body being operatively mounted to the loader for movement between its first position and its second position, and the actuator means being adapted to move the discharge cone to the closed position thereof in response to the signal from the sensor means.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinafter.

DETAILED DESCRIPTION OF THE PREFERRED EMBODIMENT

Figure 1:
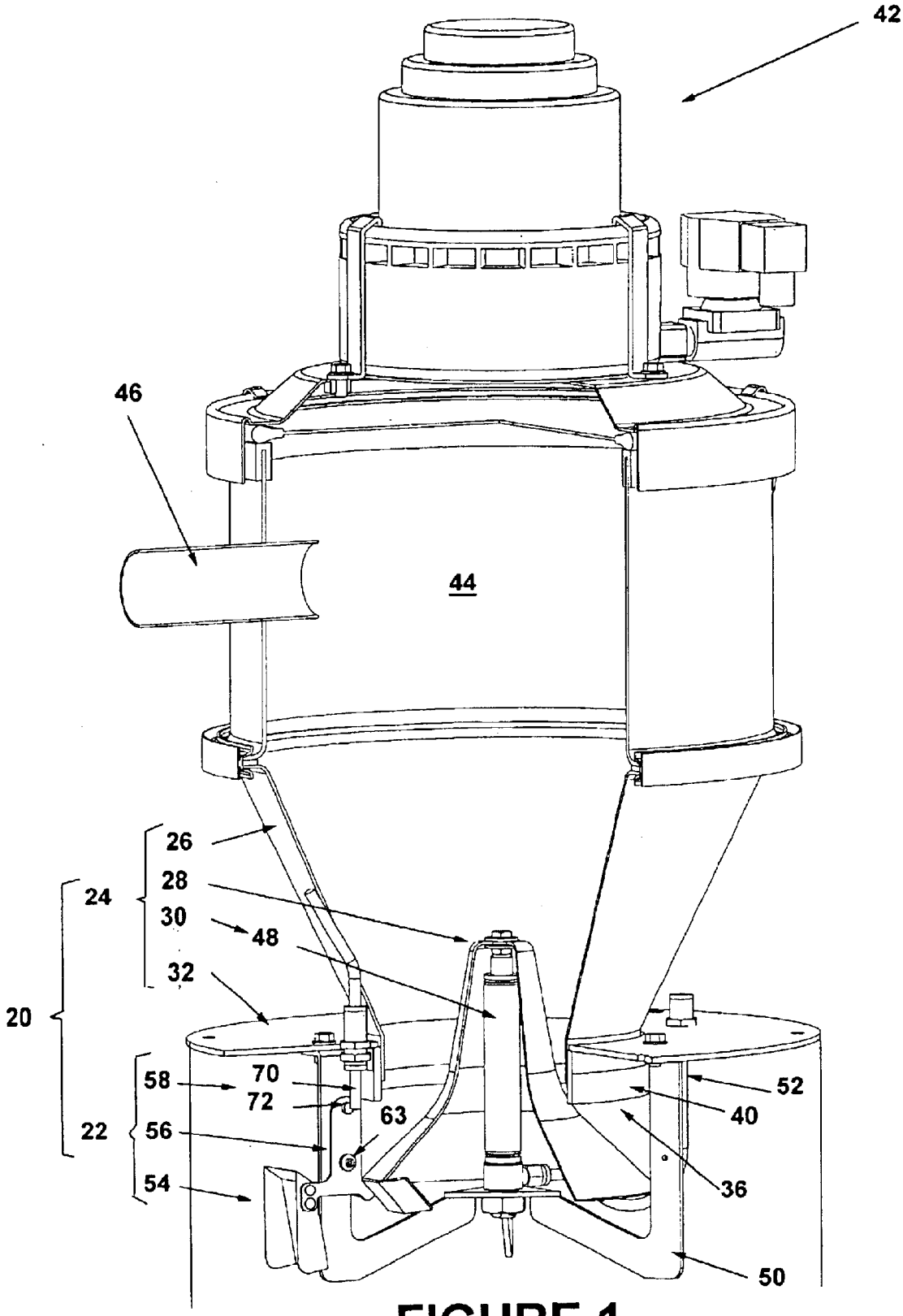
FIG. 1 is a perspective partial cutaway view of a preferred embodiment of the trigger apparatus of the invention in use with a loader to form the material handling apparatus of the invention.

Referring generally to FIGS. 1–10 of the drawings, a material handling apparatus according to the invention is shown, said apparatus being designated with general reference numeral 20 in FIG. 1.

The material handling apparatus 20 includes a preferred embodiment of the trigger apparatus of the invention in use with a loader which are designated, respectively, with general reference numerals 22 and 24.

For simplicity, the loader 24 will firstly be described, and will be understood to include a hopper, a discharge cone, actuator means and a receptacle, designated respectively with general reference numerals 26, 28, 30 and 32.

The hopper 26 is for receiving particulate solid material and has a discharge port 36 at the base 40 thereof. The hopper 26 is of the type including an evacuation fan 42 which draws air from the interior 44 of the hopper 26, so as to provide for particulate solid material to be conveyed pneumatically through a conduit 46 extending to a central storage area (not shown). "Particulate solid material", for the purpose of the present description and claims, shall be taken to mean any particulate solid material capable of fluidic flow, such as granular material or powder material, and especially plastic resin powder.

Figure 2:
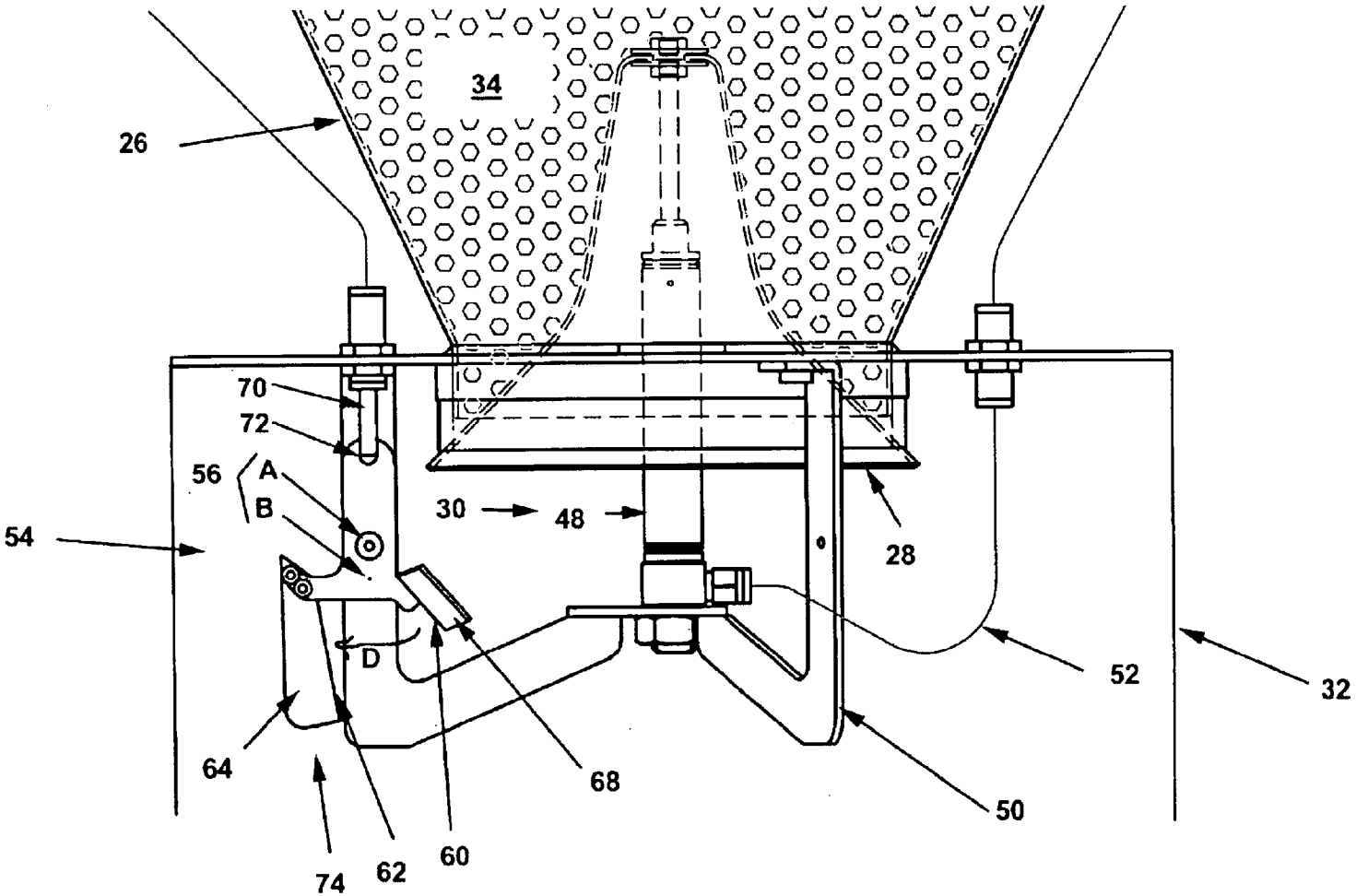
FIG. 2 is a side elevational view of a portion of the structure of FIG. 1, with hidden parts shown in phantom outline.
Figure 4:
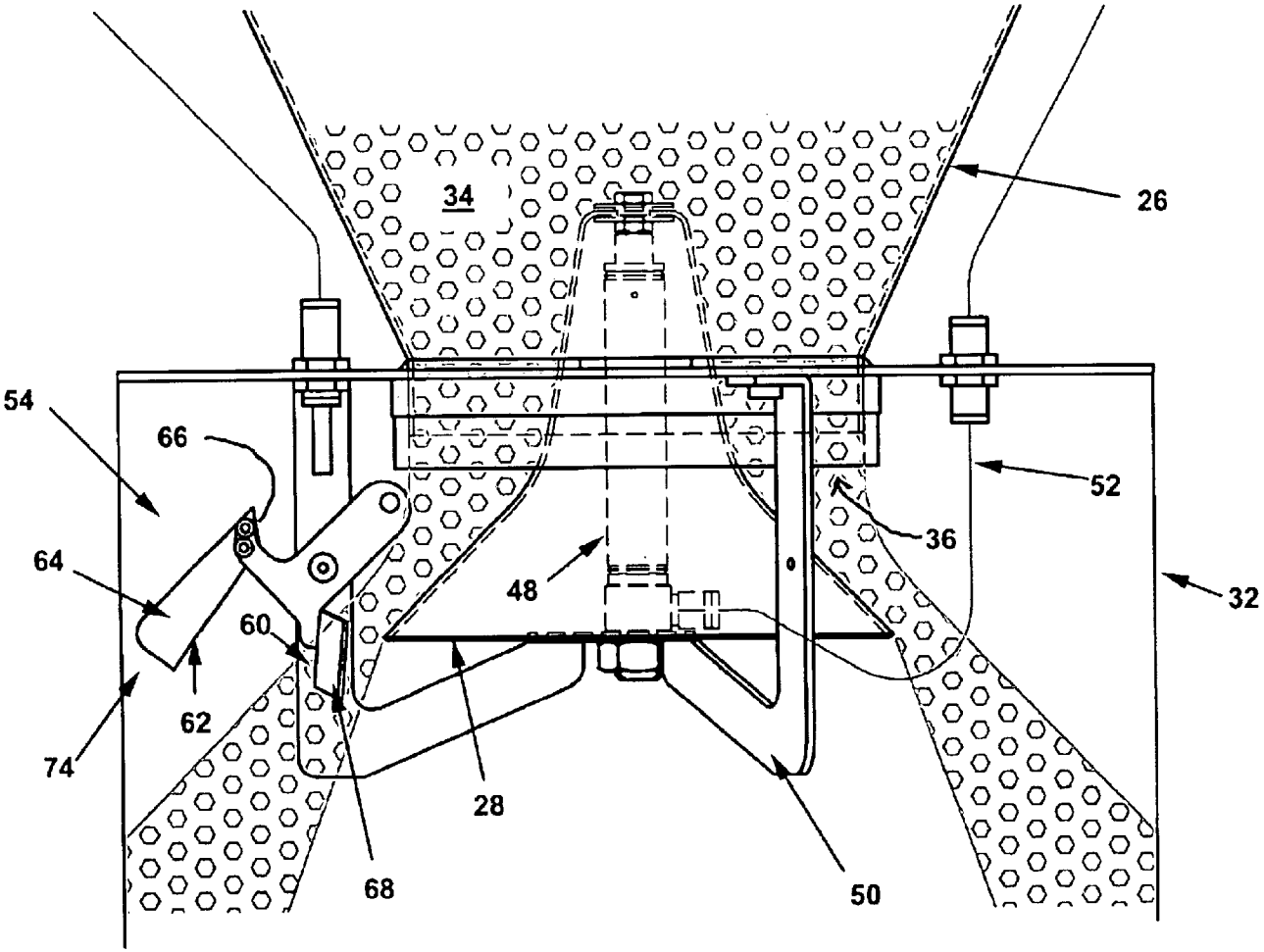
FIG. 4 is a view similar to FIG. 3, in flow conditions, with the trigger body pivoted to its second position.

The discharge cone 28 has an open position, apart from the discharge port 36 and shown, inter alia, in FIG. 4, whereat particulate solid material 34 within said hopper 26 can flow through said discharge port 36, and a closed position, occluding said discharge port 36 and shown in FIG. 2, whereat said flow is arrested.

The actuator means 30 is for selectively moving the discharge cone 28 between the open position and the closed position thereof and, in the preferred embodiment illustrated representatively in FIG. 1, comprises a pneumatic cylinder 48 which securely extends between the discharge cone 28 and a bracket 50 spanning beneath the discharge port 36 and which is coupled by a conduit 52 to a suitable supply of compressed air (not shown) for extension.

The receptacle 32 is positioned beneath said hopper 26 to receive particulate solid material 34 discharged through said discharge port 36.

Turning now to the trigger apparatus 22 of the preferred embodiment, same will be understood to comprise a trigger body, bias means and sensor means, designated respectively with general reference numerals 54, 56 and 58, and to be for use with a material port through which a flow of particulate solid material selectively passes, which material port, in the material handling apparatus 20 illustrated, is defined by the discharge port 36 of the hopper 26.

Figure 11:
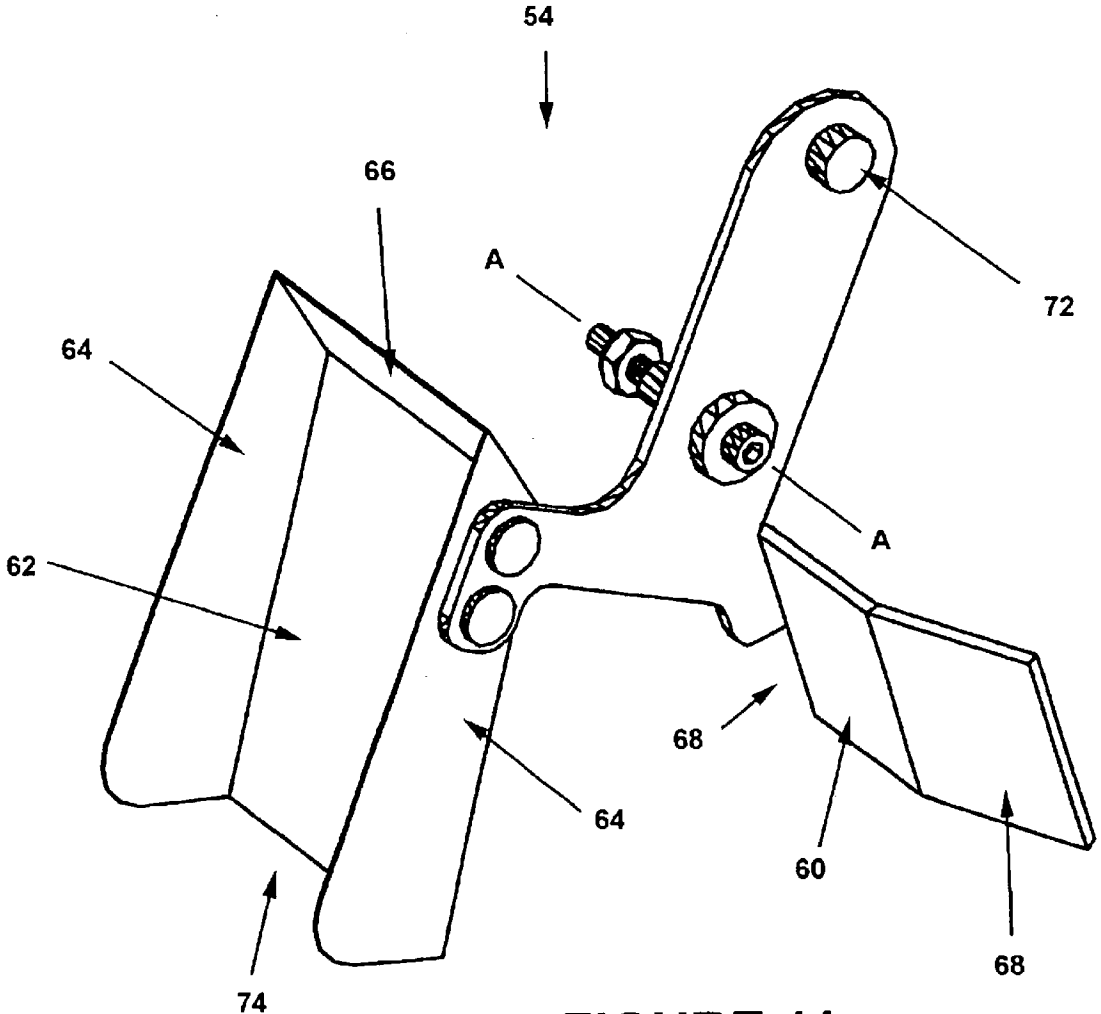
FIG. 11 is a front, top, right side perspective view of the trigger body of FIG. 1.

As best indicated in FIG. 11, the trigger body 54 defines a trigger axis A—A and comprises a vane portion 60 and a float portion 62, each being substantially planar and orientated substantially parallel to said trigger axis A—A.

As illustrated in FIG. 1, the trigger body 54 is positioned beneath said discharge port 36, and is pivotally mounted to the loader 24, specifically, to bracket 50 thereof, by a pivot pin 63, for movement between a first position shown in FIG. 2 and a second position shown in FIG. 4.

As best illustrated in FIG. 11, the trigger body 54 further comprises side walls 64,64, a top wall 66 and wing portions 68,68, which will be fully described in following paragraphs.

The bias means 56 is for biasing the trigger body 54 for movement to its first position and in the preferred embodiment illustrated is provided by forming trigger body 54 such that, when at its first position, its centre of gravity B is disposed beneath the trigger axis A—A, as is indicated in FIG. 2.

The sensor means 58 is for producing a signal responsive to movement of the trigger body 54 to its first position, and in the preferred embodiment illustrated comprises a magnetic switch 70 and a magnet 72 mounted to and forming part of, respectively, the loader 24 and the trigger body 54 such that, at the first position of the trigger body 54, as shown in FIG. 1, magnet 72 actuates the magnetic switch 70.

In operation, the hopper 26 will, as illustrated in FIG. 2, initially contain a volume of particulate solid material, and the discharge cone 28 will be disposed at its closed position.

Figure 3:
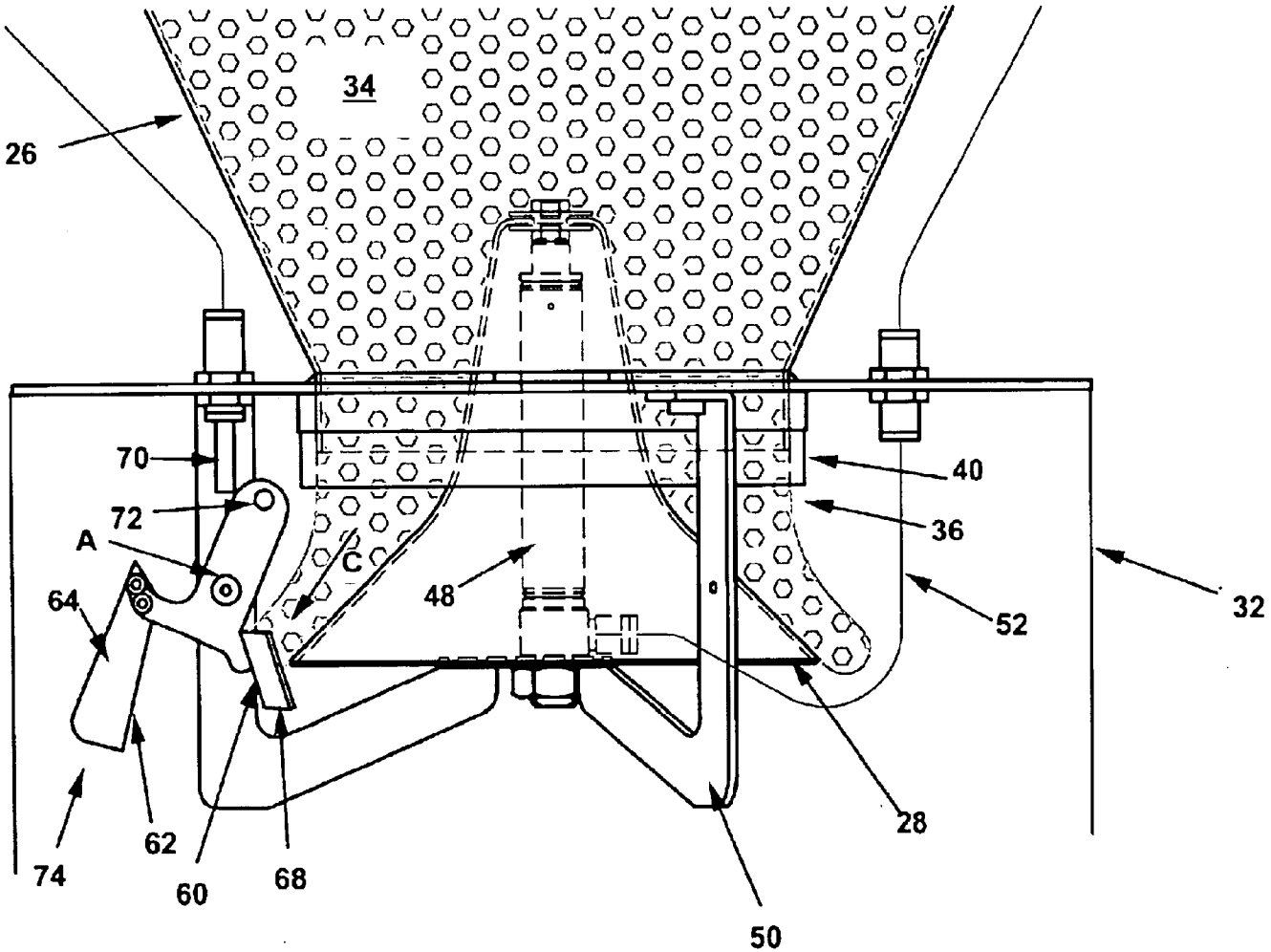
FIG. 3 is a view similar to FIG. 2, in initial flow conditions, with the discharge cone of the loader shown at its open position and the trigger body pivoted toward its second position.

When the receptacle 32 is in need of additional particulate solid material, the discharge cone 28 is moved, through the agency of actuator means 30, to its open position, as shown in FIG. 3, to permit flow of said particulate solid material 34. The direction of flow is indicated in FIG. 3 by arrow C.

As will be evident, upon comparison of FIG. 2 and FIG. 3, at initial flow conditions, the trigger body 54, and more specifically, the vane portion 60 thereof, is positioned so as to be impinged upon by said flow, with the vane portion 60 orientated substantially normal to the direction C of said flow at the location of impingement.

This impingement provides for movement of the trigger body 54 from its first position to its second position, as indicated by the direction of arrow D in FIG. 2. Aforementioned wing portions 68,68 work to impede flow of solid particulate material 34 around the vane portion 60, thereby to increase drag forces and resultant pivotal movement of the trigger body 54.

During such flow, particulate solid material accumulates in the receptacle 32.

Figure 5:
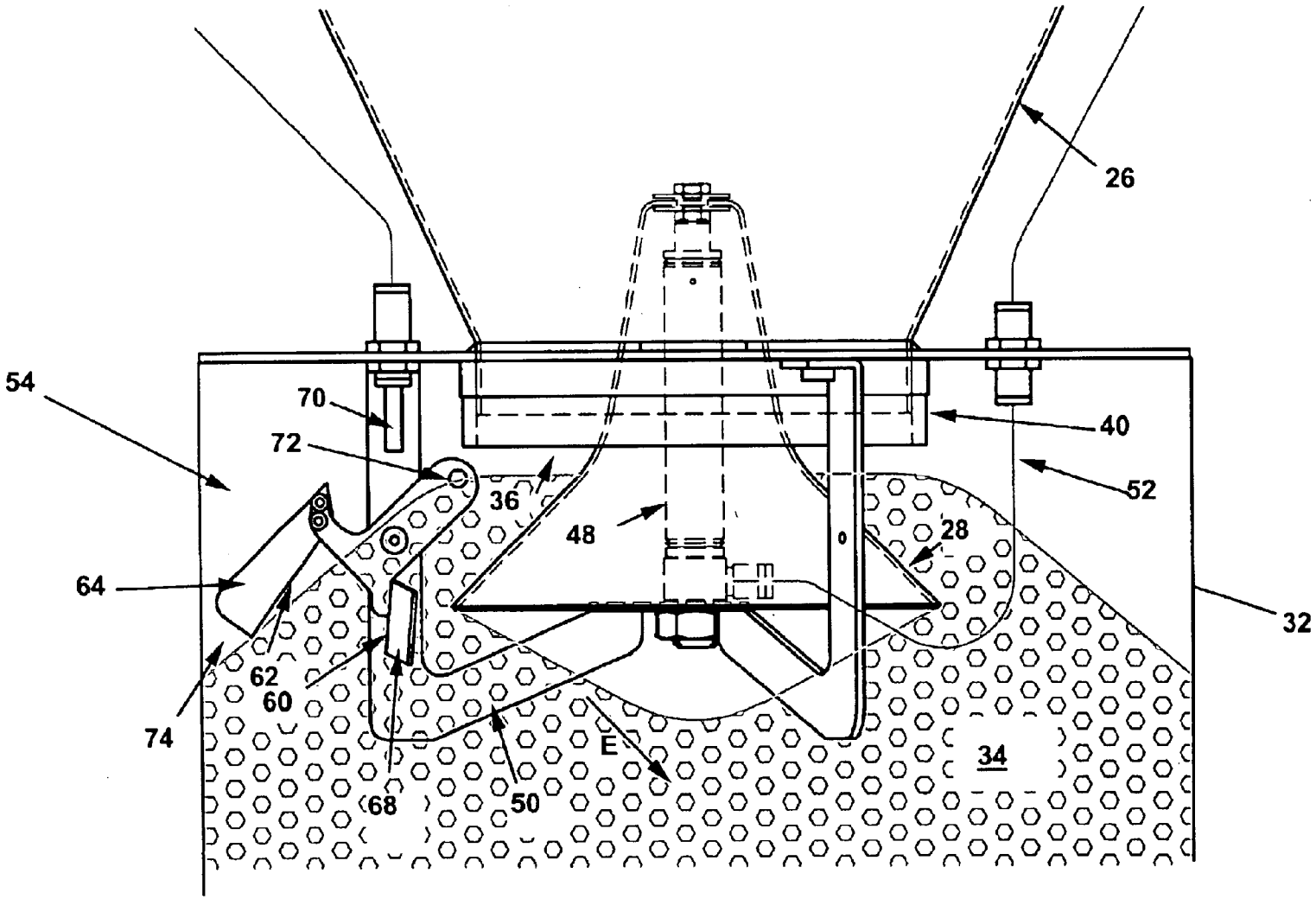
FIG. 5 is a view similar to FIG. 4, in non-flow conditions, wherein particulate solid material from said flow has accumulated beneath the discharge port of the hopper.
Figure 6:
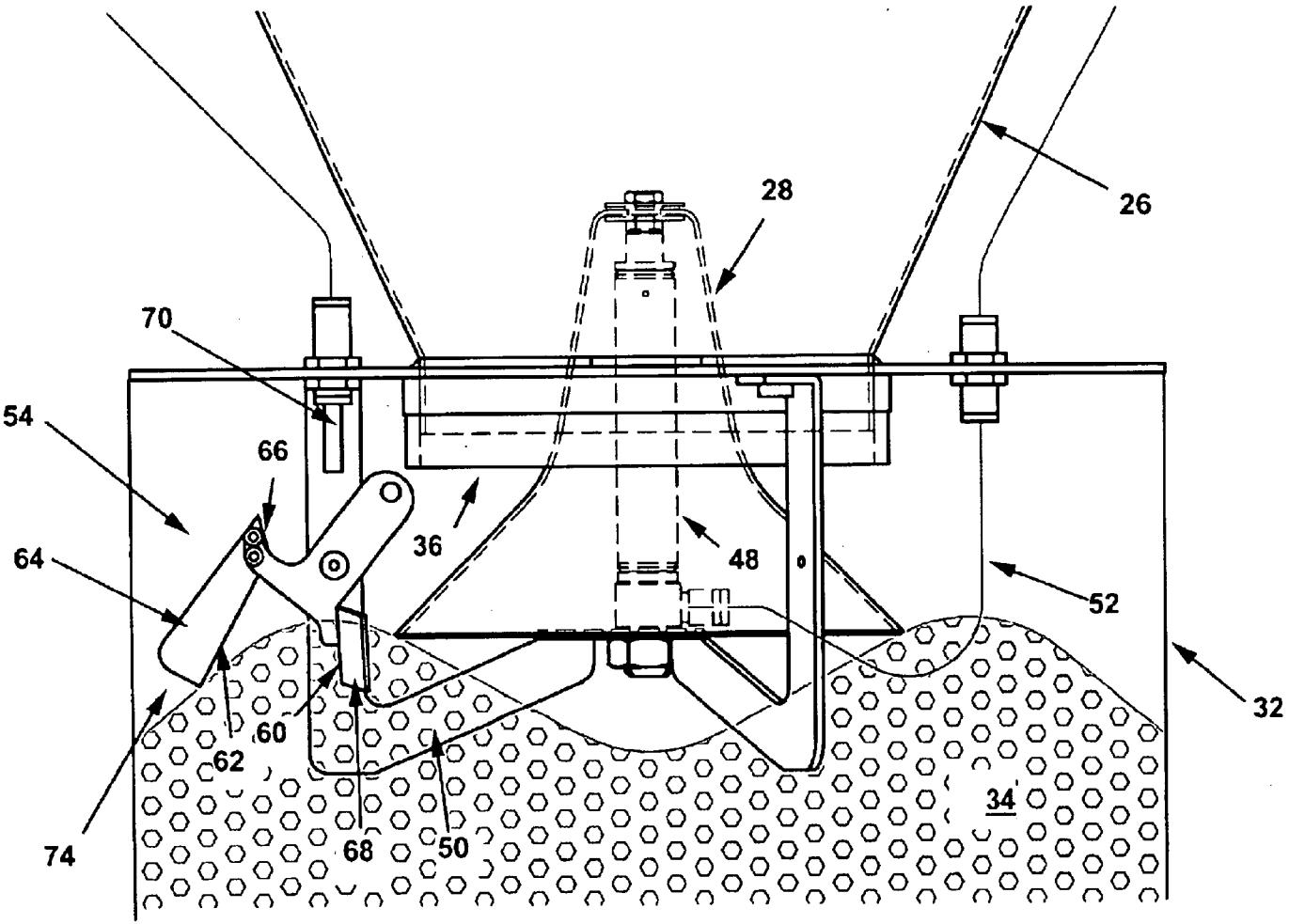
FIG. 6 is a view similar to FIG. 5, wherein accumulated particulate solid material from said flow has receded.
Figure 7:
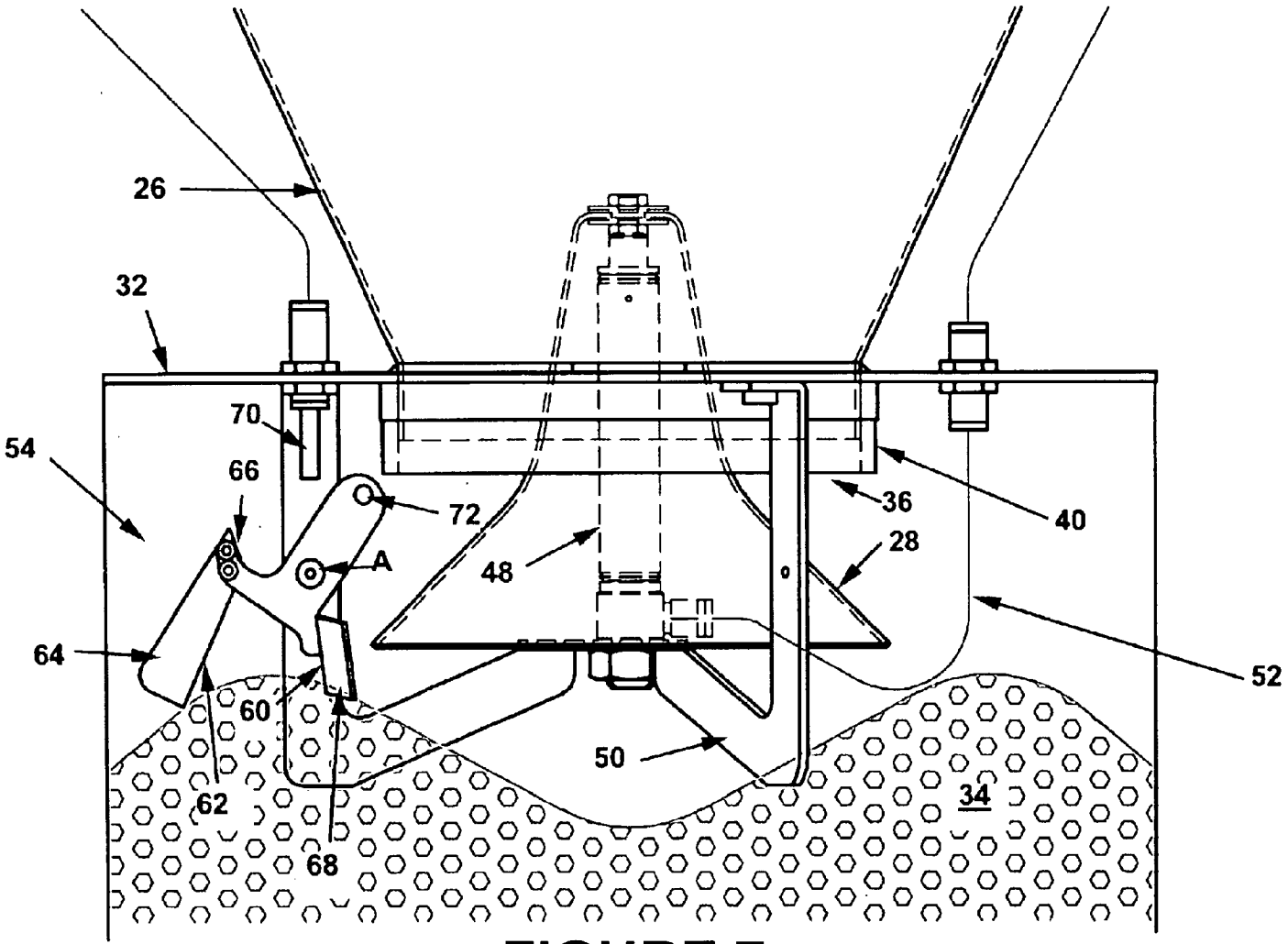
FIG. 7 is a view similar to FIG. 6, wherein accumulated particulate solid material from said flow has receded further.

Flow continues into the receptacle 32 until hopper 26 is empty, whereupon the trigger body 54, more specifically, the vane portion 60 thereof, is immersed in said particulate solid material 34, as shown in FIG. 5.

In contrast, float portion 62, which is disposed apart from the flow, as shown in FIG. 4, remains above the accumulated solid particulate material. So as to minimize the potential for particulate solid material accumulating on the float portion 62, the aforementioned side walls 64,64 and top wall 66 are secured atop the float portion 62, as best seen in FIG. 11, to impede spillover during flow conditions. In the event that particulate solid material is inadvertently deposited on the float portion 62 in flow conditions, the float portion 62, side walls 64,64 and top wall 66 together form a chute 74, to provide egress for such deposited material.

In conditions as shown in FIG. 5, movement of the trigger body 54 to its first position through the agency of the bias means 56 is arrested as a result of the accumulation of particulate solid material around the vane portion 60. As well, movement of the trigger body 54 is arrested as a result of the abutting contact of the float portion 62 with the surface of the accumulated particulate solid material 34.

From the situation illustrated in FIG. 5, particulate solid material may be drawn centrally from the receptacle 32, to feed a melt extruder, or the like (not shown). As a result of this central withdrawal, slight "currents" may be formed in the particulate solid material 34, illustrated representatively by arrow E in FIG. 5, thereby producing drag forces on the vane portion 60 which forces work to urge the trigger body 54 towards the first position, in concert with the moment forces created by the bias means 56. However, the float portion 62 is sized sufficiently as not to be drawn into the bulk. As a result, trigger body 54 will pivot only to follow the surface of the accumulated particulate material 34, as indicated by the sequence of FIGS. 5–8.

Figure 8:
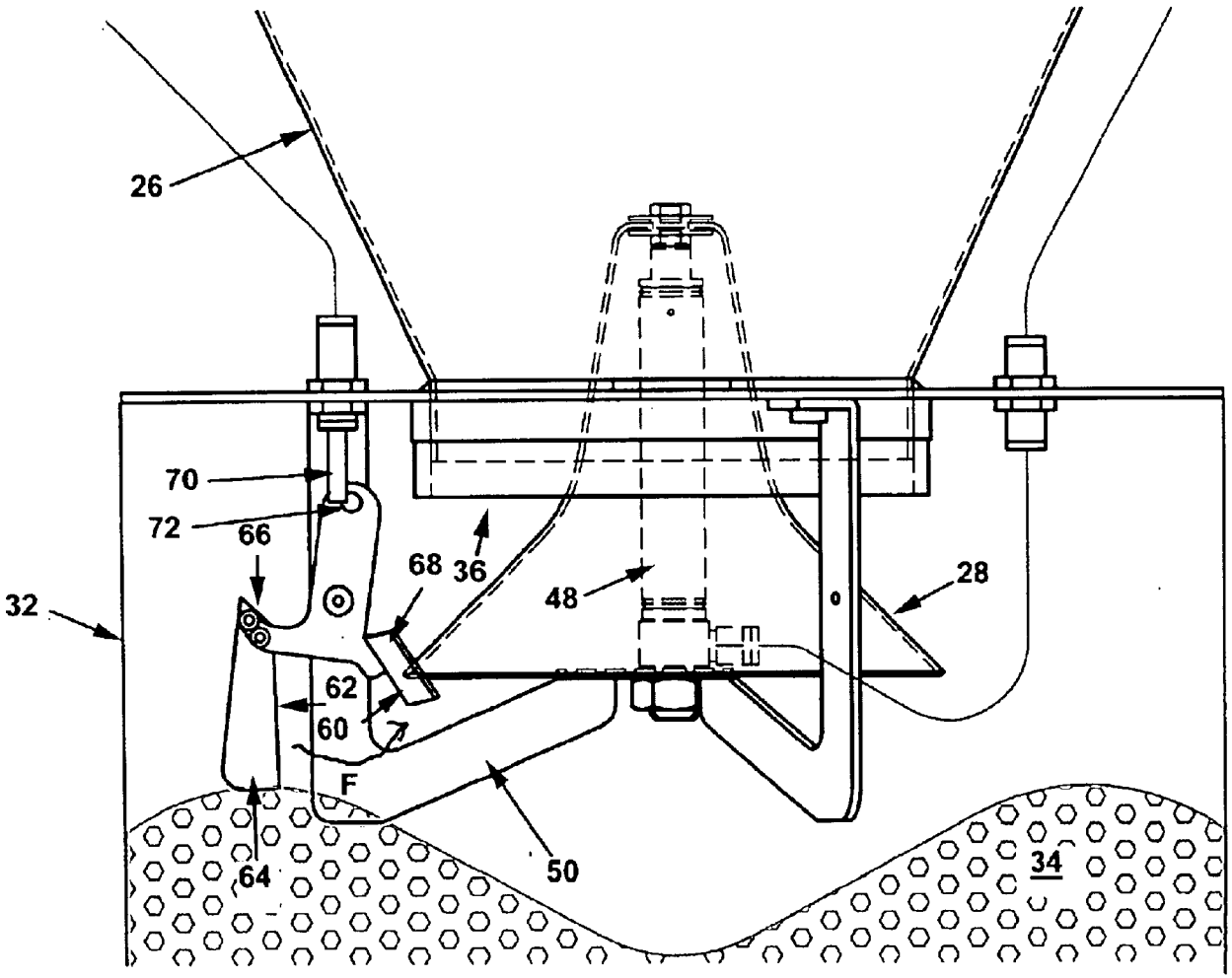
FIG. 8 is a view similar to FIG. 7, wherein the accumulated particulate solid material has receded to the threshold level.
Figure 9:
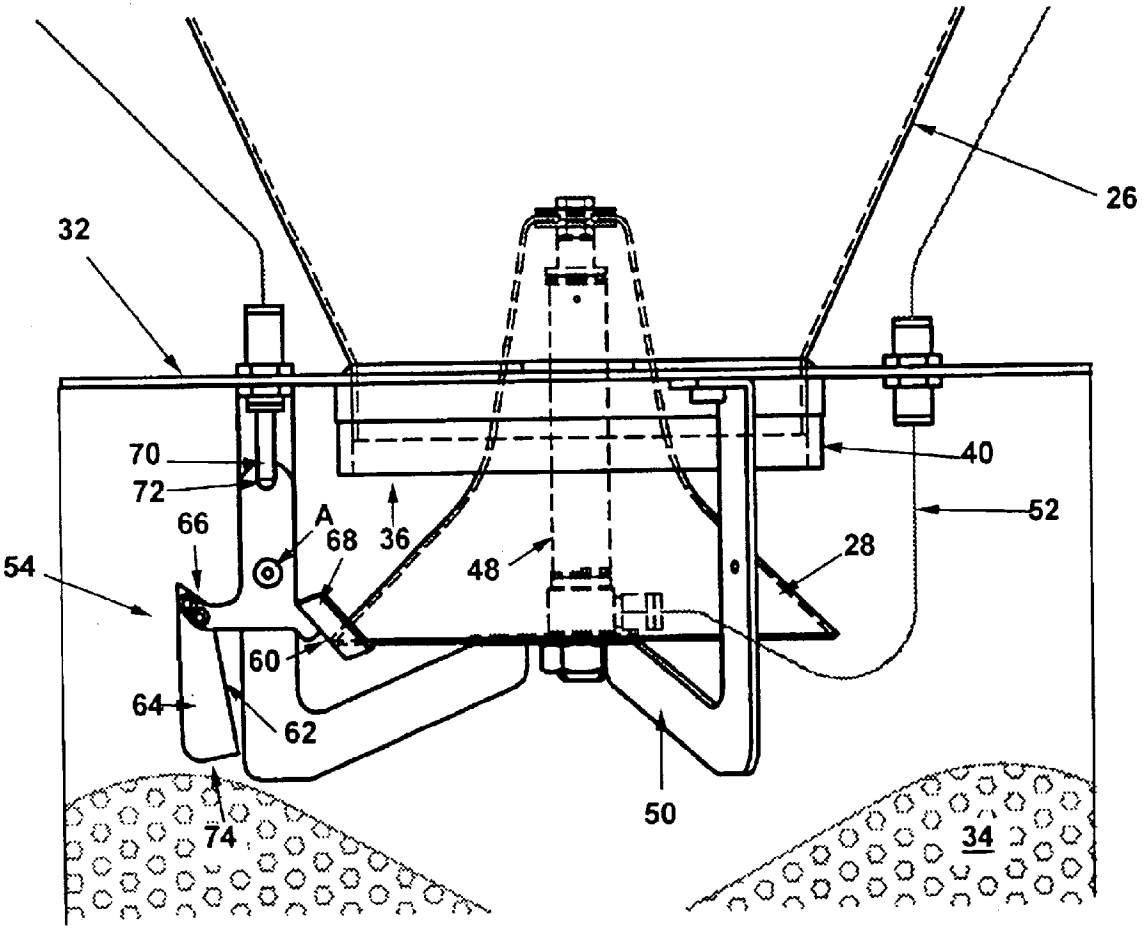
FIG. 9 is a view similar to FIG. 8, wherein the trigger body has pivoted to its first position, and the particulate solid material has receded below the threshold level.
Figure 10:
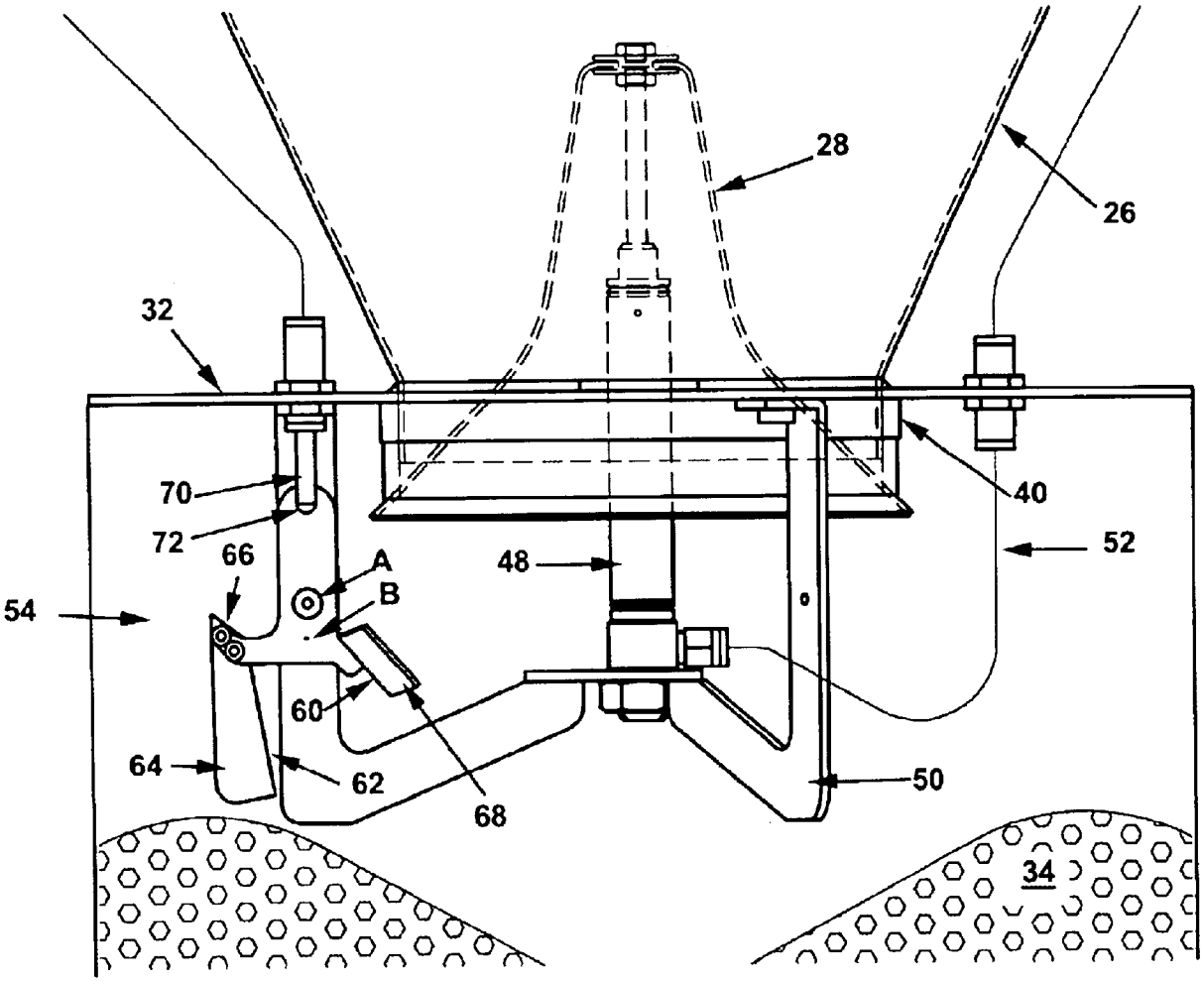
FIG. 10 is a view similar to FIG. 9, with the discharge cone at its closed position.

Eventually, as withdrawal continues, the particulate solid material 34 will recede to a threshold level, as shown in FIG. 8, whereat any further material withdrawal will result in the trigger body 54 becoming freed from the particulate solid material 34, whereupon it will pivot, as indicated by arrow F in FIG. 8, to its first position shown in FIG. 9.

At this time it should be noted that the threshold level is not defined merely by the lowermost extent of the float portion 62 at the moment before it becomes freed for rotation, since the moment of the trigger body 54 at positions apart from the first position thereof will be sufficient to dislodge a small amount of particulate solid material, the quantum of which will depend upon the physical characteristics of the particulate solid material being used.

Thus, for any given particulate solid material, the trigger body 54, and more specifically, its geometric and gravimetric particulars, will define the threshold level.

In any event, upon movement of the trigger body 54 to its first position, as shown in FIG. 9, the magnet 72 actuates the magnetic switch 70, thereby generating a signal, in response to which, the discharge cone 28 is moved by actuator means 30 to the closed position, whereupon further particulate solid material can be drawn into the hopper 26 for subsequent discharge, in the conventional manner.

Other modifications and alterations may be used in the design and manufacture of the trigger apparatus according to the present invention without departing from its spirit and scope.

For example, whereas the sensor means of the preferred embodiment illustrated comprises a magnetic switch, other sensor arrangements, for example, contact switches, could be used.

As well, whereas the vane portion and the float portion of the preferred embodiment are substantially planar, other configurations could be utilized, and indeed, the float portion could be omitted altogether, in which event, immersion of the vane portion in the particulate solid material would control movement to the first position.

Yet further, whereas in the preferred embodiment illustrated, the vane portion is initially immersed in the particulate solid material, this need not be the case.

Additionally, whereas in the preferred embodiment illustrated, the bias means is provided by a manner of weighting the trigger body, other mechanisms, such as spring-biasing, could be utilized with similar utility.

As well, whereas in the illustrations, the threshold level of the particulate solid material is shown to be substantially undulatory, as a result of the manner in which the material is withdrawn from the receptacle, and the angle of repose of the particulate solid material, it should be understood that the threshold level need not follow the same contours as illustrated, and indeed, need not be undulatory at all.

Accordingly, the scope of the present invention should be understood as limited only by the accompanying claims, purposively construed.

We claim:

1. A trigger apparatus for use with a material port through which a flow of particulate solid material selectively passes, said trigger apparatus comprising:

a trigger body having a first position and a second position and defining a threshold level of said particulate solid material, the trigger body being adapted to be positioned, in use, beneath said material port so as be impinged upon by said flow when at its first position and moved therefrom by said flow to its second position, and further being adapted, upon accumulation of said particulate solid material from said flow beneath said material port beyond the threshold level, to be restrained as against movement to said first position by said particulate solid material until such time as the particulate solid material recedes to said threshold level;

bias means for biasing the trigger body for movement to its first position; and sensor means operatively connected to the trigger body for producing a signal responsive to movement of the trigger body to its first position.

2. A trigger apparatus according to claim 1, wherein the sensor means comprises a magnetic switch and a magnet.

3. A trigger apparatus according to claim 1, wherein the trigger body comprises a vane portion, wherein, in use, said vane portion is impinged upon by said flow and wherein said impingement of said flow upon said vane portion provides for said movement of the trigger body from its first position to its second position.

4. A trigger apparatus according to claim 3, wherein the trigger body further comprises a float portion and wherein, in non-flow conditions when said particulate solid material has accumulated from said flow beneath said material port beyond the threshold level, said particulate solid material blocks movement of the float portion, in the course of said movement of the trigger body from its second position to its first position through the agency of the bias means, thereby to provide for said trigger body to be restrained as against movement to said first position by said particulate solid material until such time as the particulate solid material recedes to said threshold level.

5. A trigger apparatus according to claim 4, wherein the trigger body defines a substantially horizontal trigger axis in use and pivots about said trigger axis during movement between its first position and its second position.

6. A trigger apparatus according to claim 5, wherein said vane portion is substantially planar and is orientated substantially parallel to said trigger axis.

7. A trigger apparatus according to claim 6, wherein, when the trigger body is at its first position, the vane portion is orientated substantially normal to the direction of said flow at the location whereat said flow impinges upon said vane portion.

8. A trigger apparatus according to claim 5, wherein said float portion is substantially planar and is orientated substantially parallel to said trigger axis.

9. A trigger apparatus according to claim 8, wherein the trigger body further comprises side walls and a top wall secured atop the float portion.

10. A trigger apparatus according to claim 5, wherein said bias means is provided by forming said trigger body such that, when at its first position in use, its centre of gravity is disposed, beneath the trigger axis.

11. A material handling apparatus for use with particulate solid material, said material handling apparatus comprising:

a loader including:

a hopper for receiving said particulate solid material, the hopper having a discharge port at the base thereof;

a discharge cone having an open position, apart from the discharge port, whereat particulate solid material within said hopper can flow through said discharge port, and a closed position, occluding said discharge port, whereat said flow is arrested;

actuator means for selectively moving the discharge cone between the open position and the closed position thereof;

a receptacle positioned beneath said hopper to receive particulate solid material discharged through said discharge port; and a trigger apparatus according to claim 1 in use with said loader with the discharge port of said hopper defining the material port, the trigger body being operatively mounted to the loader for movement between its first position and its second position, and the actuator means being adapted to move the discharge cone to the closed position thereof in response to the signal from the sensor means.

12. A material handling apparatus according to claim 11, wherein the sensor means comprises a magnetic switch and a magnet mounted to and forming part of, respectively, the loader and the trigger body.

13. A material handling apparatus according to claim 11, wherein the trigger body comprises a vane portion, wherein, in use, said vane portion is impinged upon by said flow and wherein said impingement of said flow upon said vane portion provides for said movement of the trigger body from its first position to its second position.

14. A material handling apparatus according to claim 13, wherein the trigger body further comprises a float portion and wherein, in non-flow conditions when said particulate solid material has accumulated from said flow beneath said material port beyond the threshold level, said particulate solid material blocks movement of the float portion, in the course of said movement of the trigger body from its first position to its second position through the agency of the bias means, thereby to provide for said trigger body to be restrained as against movement to said first position by said particulate solid material until such time as the particulate solid material recedes to said threshold level.

15. A material handling apparatus according to claim 14, wherein the trigger body defines a substantially horizontal trigger axis in use and pivots about said trigger axis during movement between its first position and its second position.

16. A material handling apparatus according to claim 15, wherein said vane portion is substantially planar and is orientated substantially parallel to said trigger axis.

17. A material handling apparatus according to claim 16, wherein, when the trigger body is at its first position, the vane portion is orientated substantially normal to the direction of said flow at the location whereat said flow impinges said vane portion.

18. A material handling apparatus according to claim 17, wherein said float portion is substantially planar, is orientated a substantially parallel to said trigger axis and is pivotally displaced relative to the vane portion.

19. A material handling apparatus according to claim 18, wherein the trigger body further comprises side walls and a top wall secured atop the float portion.

20. A material handling apparatus according to claim 15, wherein said bias means is provided by forming said trigger bed such that, when at its first position in use, its centre of gravity is disposed beneath the trigger axis.

* * * * *